US010974477B1

(12) United States Patent
Hsu

(10) Patent No.: US 10,974,477 B1
(45) Date of Patent: Apr. 13, 2021

(54) METHOD OF MAKING A PAPER STRAW WITH A BEND

(71) Applicant: Wei Hsu, Plano, TX (US)

(72) Inventor: Wei Hsu, Plano, TX (US)

( * ) Notice: Subject to any disclaimer, the term of this patent is extended or adjusted under 35 U.S.C. 154(b) by 18 days.

(21) Appl. No.: 16/536,847

(22) Filed: Aug. 9, 2019

(51) Int. Cl.
*B31D 5/00* (2017.01)
*A47G 21/18* (2006.01)

(52) U.S. Cl.
CPC ..... *B31D 5/0095* (2013.01); *A47G 21/18* (2013.01)

(58) Field of Classification Search
CPC .... B31D 5/0095; A47G 21/18; A47G 21/186; A47G 21/189
USPC ..... 493/276
See application file for complete search history.

(56) References Cited

U.S. PATENT DOCUMENTS 3,203,325 A * 8/1965 Davis ..... B29C 53/60 493/288
3,468,733 A * 9/1969 Dunlap, Jr. ..... B29C 65/00 156/190
3,555,976 A * 1/1971 Carter ..... B31C 3/04 493/274
5,019,024 A * 5/1991 Cutright ..... B29C 53/8016 493/279

* cited by examiner

*Primary Examiner* — Chelsea E Stinson
(74) *Attorney, Agent, or Firm* — Richard Eldredge; Leavitt Eldredge Law Firm

(57) ABSTRACT

A method of making a paper straw with a bend includes coating a strip of paper with polyethylene on a first side and a second side of the strip of paper; cutting the strip of paper to a desired length; providing a spring apparatus of a predetermined length; rolling the strip of paper around the spring apparatus such that the strip of paper partially overlaps with itself to form a straw, the polyethylene holding the strip of paper in a rolled position; applying steam to the straw; and bending the straw to create a bend, the straw remains bent; and removing the spring apparatus from the straw.

2 Claims, 4 Drawing Sheets

METHOD OF MAKING A PAPER STRAW WITH A BEND

BACKGROUND

1. Field of the Invention

The present invention relates generally to drinking straws systems, and more specifically, to a paper straw with a bend.

2. Description of Related Art

Drinking straw systems are well known in the art and are effective means to drink from glasses, mugs, and other dishware without having the need to come into physical contact with the container. For example, FIG. 1 depicts a conventional drinking straw 101 having a cylindrical elongated body with a hollow center 102 with two open ends 103, 104. During use, as depicted in FIG. 2, the user places one end 103 of the drinking straw system 101 in a glass 105 and drinks from the opposing end 104.

One of the problems commonly associated with system 101 is environmental pollution. Most straws are composed of a plastic or similar material, which takes a very long time to decompose and therefore is damaging and hazardous to the environment. Accordingly, it would be desirable to have a drinking straw composed of a more environmentally friendly material.

Accordingly, although great strides have been made in the area of drinking straw systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 2:
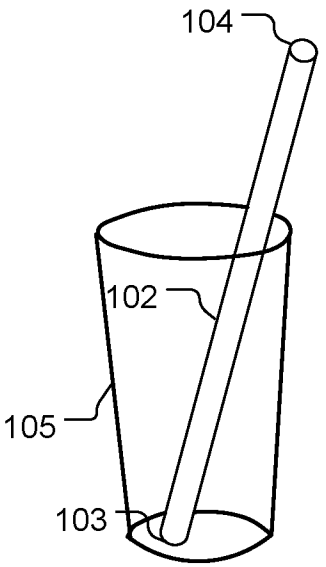
FIG. 2 (Prior Art)
FIG. 2 is a front view of a common drinking straw system in use.
Figure 1:
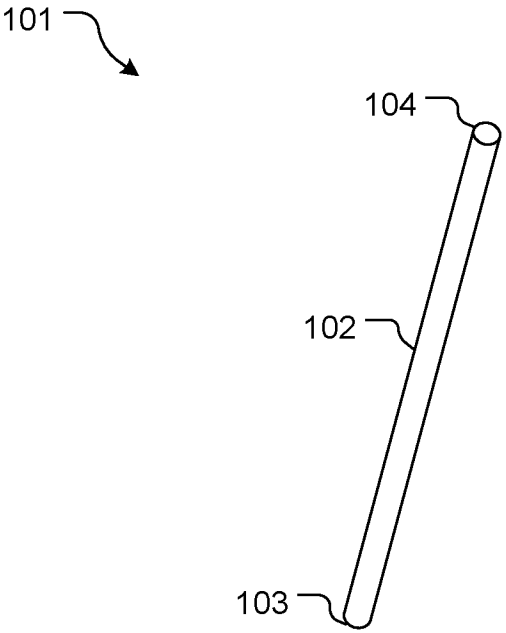
FIG. 1 (Prior Art)
FIG. 1 is a front view of a common drinking straw system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional drinking straw systems. Specifically, the present invention provides for a method of making a paper drinking straw with a bend that provides for an environmentally friendly straw. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 3:
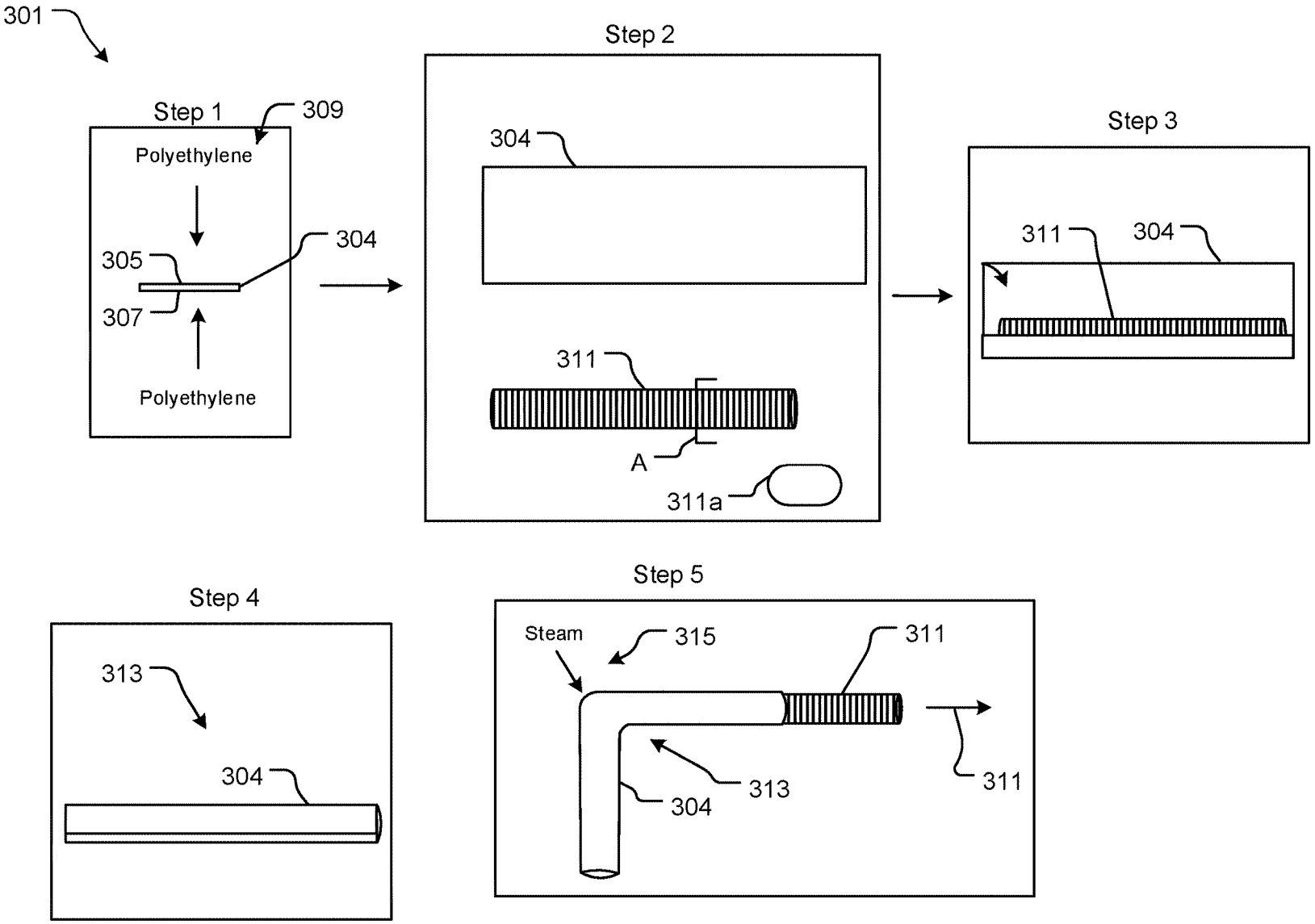
FIG. 3 is a first schematic depicting the method of making a paper straw with a bend in accordance with the present application.

Referring now to the drawings wherein like reference characters identify corresponding or similar elements throughout the several views, FIG. 3 depicts a schematic of a method 301 of making a paper straw with a bend 303 in accordance with a preferred embodiment of the present application. It will be appreciated that straw 303 overcomes one or more of the above-listed problems commonly associated with conventional drinking straw systems.

In the contemplated embodiment, method 301 includes a first step wherein a strip of paper 304 is coated on a first and second surface 305, 307 with polyethylene 309. The polyethylene 309 provides for sanitation, reduced friction, and securing of the strip of paper 307 around a spring apparatus 311.

As shown in Steps 2, 3 and 4, the coated strip of paper 304 is wrapped around the spring apparatus 311 to form a straw 313. As shown, in one embodiment, the spring apparatus 311 has an oblong shape 311*a*, taken from line A. Once the paper 304 is fully rolled, such that the edges of the paper overlap and the polyethylene 309 secures the strip of paper together, steam 315 can be applied to loosen the paper and allow bending, as shown in Step 5. The use of a spring allows for the entire apparatus to bend 313. As the paper cools, it maintains the bent shape to result in a straw with a bend 313. The spring apparatus 311 will compress upon stretching thereby allowing for easy removal from the paper straw, as shown in Step 5, arrow B.

It should be appreciated that one of the unique features believed characteristic of the present application is the method of creating a bent straw with paper, thereby allowing for a user to have an environmentally friendly straw that is also bent for convenience.

Figure 4:
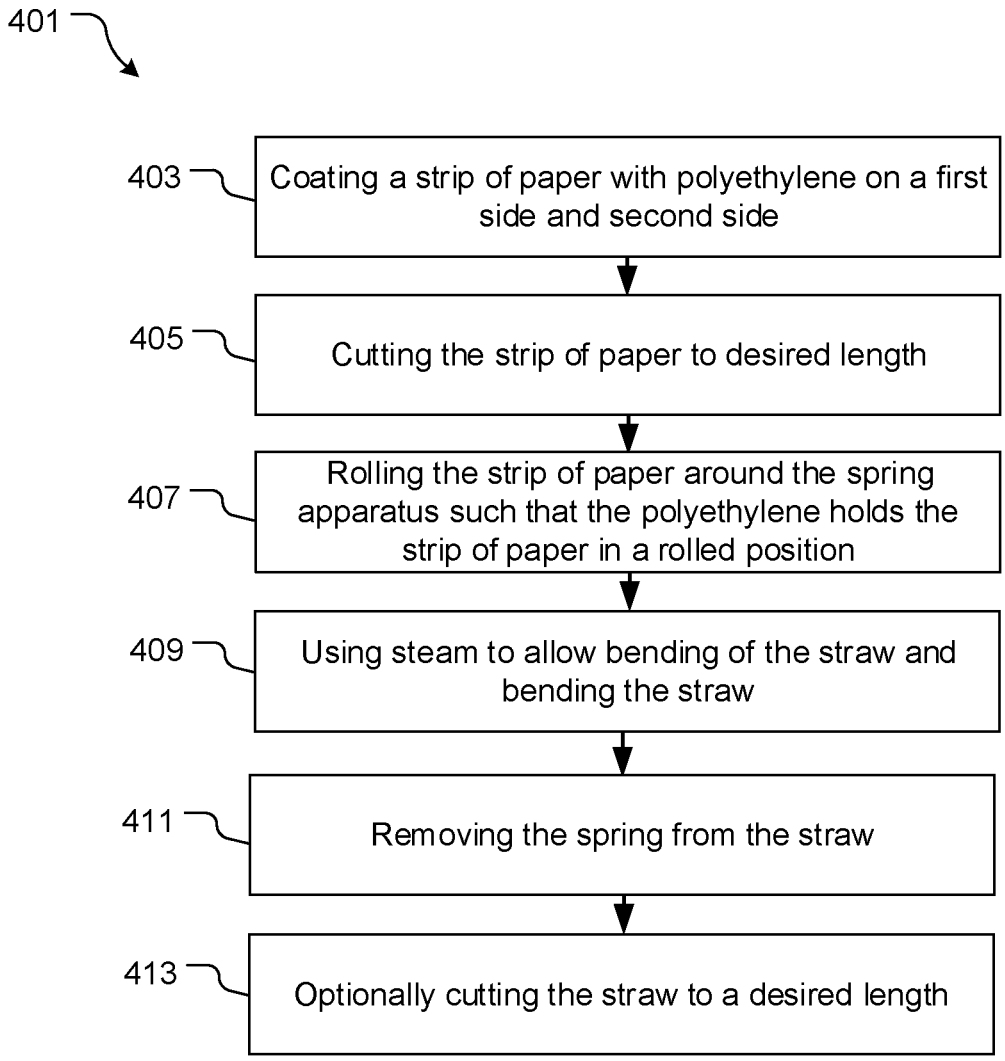
FIG. 4 is a flowchart of the method associated with FIG. 3.

In FIG. 4, a flowchart 401 further depicts the method associated with FIG. 3. During use, the strip of paper is coated with polyethylene on a first side and a second side and the strip of paper can be cut to a desired length, as shown with boxes 403, 405. The strip of paper can then be rolled around the spring apparatus such that the polyethylene holds the strip of paper in a rolled position to form a straw, as shown with box 407. Steam can be used to loosen the paper to allow bending, wherein the straw will maintain a desired shape once cooled, as shown with box 409. The spring apparatus can then be removed, and if desired, the straw can be cut to a deired length, as shown with boxes 411, 413.

Figure 5:
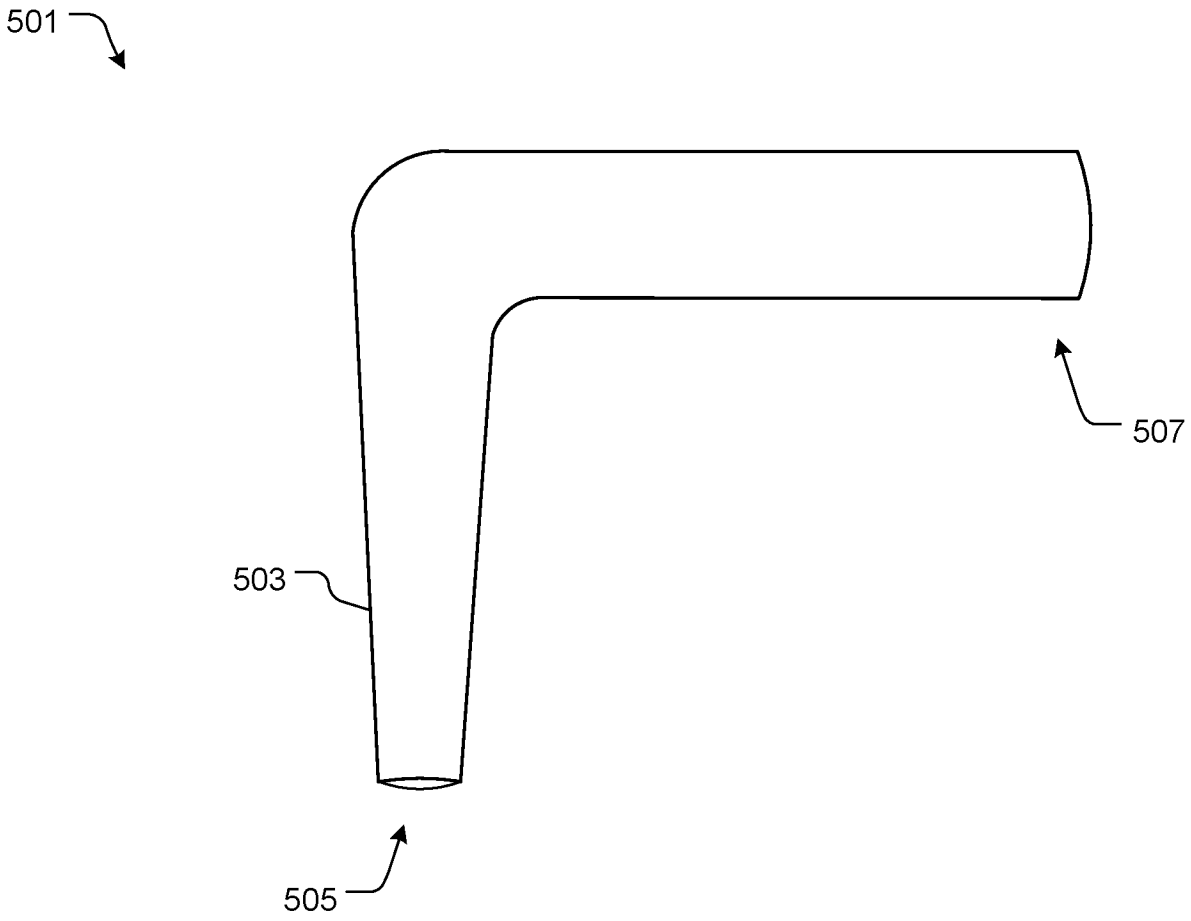
FIG. 5 is a side view of a straw as made by the method of FIGS. 3 and 4.

In FIG. 5, a side view depicts a straw 501 as created with the aforementioned method. As shown, the straw 501 includes a body 503 that extends from a first end 505 to a second end 507. The first end 505 can be smaller than the second and rounded.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A method of making a paper straw with a bend, the method comprising:

coating a strip of paper with a polyethylene adhesive on a first side and a second side of the strip of paper;

cutting the strip of paper to a desired length;

providing a spring apparatus of a predetermined length;

rolling the strip of paper around the spring apparatus such that the strip of paper partially overlaps with itself to form a straw, the polyethylene holding the strip of paper in a rolled position, the strip of paper extending the entire elongated length of the spring apparatus;

applying steam to the straw while the spring apparatus is wrapped with the strip of paper;

bending the straw to create a bend, wherein the straw remains in a bent configuration upon cooling; and removing the spring apparatus from the straw.

2. The method of claim 1, further comprising:

cutting the straw to a desired length after the spring apparatus is removed.

* * * * *